US005568990A

United States Patent [19]

McAuley

[11] Patent Number: 5,568,990

[45] Date of Patent: Oct. 29, 1996

[54] SHOE POLISH APPLICATOR

[76] Inventor: Brian McAuley, 896 S. Columbus Ave., Mt. Vernon, N.Y. 10550

[21] Appl. No.: 413,091

[22] Filed: Mar. 29, 1995

[51] Int. Cl.[6] ..... A47L 23/05; A47L 13/17

[52] U.S. Cl. ..... 401/206; 401/260; 401/273

[58] Field of Search ..... 401/206, 207, 401/260, 273

[56] References Cited

U.S. PATENT DOCUMENTS

| | | | |
|---|---|---|---|
| 2,974,350 | 3/1961 | Schwartzman | 401/206 |
| 3,169,267 | 2/1965 | Luedtke | 401/206 |
| 3,203,026 | 8/1965 | Schwartzman | 401/206 |
| 3,264,676 | 8/1966 | Schwartzman | 401/206 X |
| 3,481,678 | 12/1969 | Schwartzman | 401/206 |
| 3,661,468 | 5/1972 | Schwartzman | 401/206 |
| 4,555,194 | 11/1985 | Hammond | 401/206 |
| 4,792,252 | 12/1988 | Kremer et al. | 401/206 |

FOREIGN PATENT DOCUMENTS

| | | | |
|---|---|---|---|
| 1492050 | 7/1967 | France | 401/206 |
| 9221448 | 10/1992 | WIPO | 401/206 |

*Primary Examiner*—Steven A. Bratlie

*Attorney, Agent, or Firm*—Cohen, Pontani, Lieberman, Pavane

[57] ABSTRACT

A liquid applicator provides for a self-sealing feature, which applicator comprises a housing, a valve member and a spring member. The housing has an aperture through its top wall and an annular sleeve projecting inwardly from an edge of the top wall in a surrounding relation with the aperture, the annular sleeve having an end portion. The valve member includes an actuating part that is slideably received by the annular sleeve and a sealing part that is shaped to form a releasable seal with the end portion of the annular sleeve. The valve and spring members are disposed in an axially displaceable relation such that the actuating part of the valve member is resiliently urged into the annular sleeve; that a part of the actuating part protrudes from the top wall of the housing; and that the sealing part of the valve member sealably engages with the end portion of the annular sleeve.

4 Claims, 2 Drawing Sheets

SHOE POLISH APPLICATOR

BACKGROUND OF THE INVENTION

1. Field of the Invention

The present invention relates to liquid applicators and, in particular, to a self-sealing liquid applicator comprising a housing, a spring member and a valve member, which valve member is arranged in an axial displacement relation with the spring member mounted in the housing and further being slideably received through an aperture defined by a top wall of the housing.

2. Description of the Prior Art

Shoe polish applicators enable a user to apply liquid polish to a shoe surface while minimizing smearing of unintended areas. Some applicators have integrally formed sponge-like spreaders to help distribute the liquid polish onto the shoe surface. Typically, a user applies the shoe polish by inverting and squeezing a flexible container attached to the applicator. A desired shine is achieved when the volatile components of the applied liquid evaporate from the shoe surface.

Most shoe polish applicators are simply built and do not provide effective seals around their discharge openings. In one applicator, for example, there is provided a rubber-like tip fit snugly over an opening of a container. The tip is completely closed except for a slit formed therethrough. Since the rubber like tip is inherently elastic, the slit is normally held shut by confronting surfaces thereof because of the inherent stiffness of the tip. However, a user may cause the slit to form an opening by deforming the tip, which tip will readily return to its original shape upon release of the user-applied force. A sponge-type spreader is usually positioned over the slit for facilitating the application of a uniform coat.

To apply the liquid polish, a user needs to invert the container and press the flexible or rubber-like tip and spreader onto a shoe surface with such a force that the tip deforms and the slit is caused to form an opening, thereby allowing the polish to flow therethrough and onto desired areas of the shoe surface. When the user disengages the applicator from the shoe surface, the rubber-like tip returns to its original shape and the slit is shut once again. An ordinary artisan will readily appreciate that the slit cannot serve as an effective seal against volatile compounds contained in the liquid polish. Thus, over time, the liquid polish in the container may simply "disappear" as by evaporation.

To remedy the aforementioned deficiency, a separate cap is usually provided for enclosing the applicator in an airtight manner by securing the cap to the container. This remedy, however, may be easily defeated since a user may not remember to close the cap or that the cap is lost.

Thus, it is desirable to provide a liquid applicator for shoe polish which is self-sealing during periods of non-use but which is selectively openable for applying the liquid polish.

SUMMARY OF THE INVENTION

A liquid applicator in accordance with the present invention is self-sealing and comprises a housing, a valve member and a spring member. The housing has a top wall with an aperture therein and an annular sleeve projecting downwardly from the top wall in register with the aperture. The annular sleeve extends into internal chamber of the housing and has a flexible end portion shaped to form a sealing surface. The valve member includes an actuating part that is slideably mounted in the annular sleeve and a sealing part that is shaped to form a releasable seal with the flexible end portion of the annular sleeve. The valve is axially displaceable relative to said sleeve and the spring resiliently urges the valve member into the annular sleeve. A portion of the actuating part of the valve protrudes from the top wall of the housing and the extent of that protrusion is limited by the sealing part of the valve member engaging the flexible end of the annular sleeve to thereby create a seal. The housing provides an inlet for fluid contained in a container, preferably flexible or deformable, as is usual in such applicators.

In one embodiment of the present invention, the sealing part of the valve member is shaped as an annular collar so that it may form a detachable seal with the flexible end of the annular sleeve when the valve member is resiliently urged into said annular sleeve.

In another embodiment, the top wall of the housing is inclined relative to the sleeve. A rubber-like spreader member is preferably mounted over the top wall and the actuating part of the valve member to form a seal over the valve member.

According to one aspect of the invention, an outer surface of the actuating part of the valve member is fluted. This feature is particularly advantageous for an applicator with an inclined top wall because the actuating part frictionally slides against an inner surface of the annular sleeve when a user presses the top wall onto a shoe surface. The fluted configuration lessens the frictional force between the sliding actuating part and the annular sleeve of the housing by advantageously minimizing the corresponding frictional areas.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings may not be drawn to scale and that they are merely conceptual in nature.

DETAILED DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
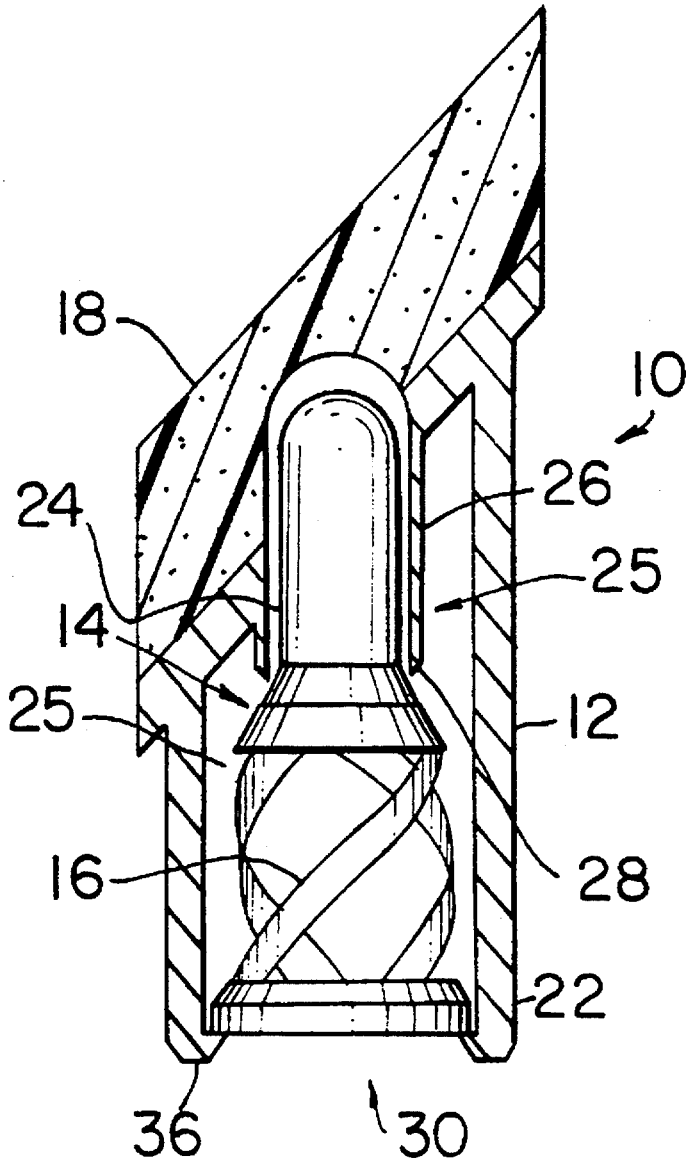
FIG. 1 is a view partly in section and partly in side elevation showing a liquid applicator constructed in accordance with a preferred embodiment of the present invention.
Figure 2:
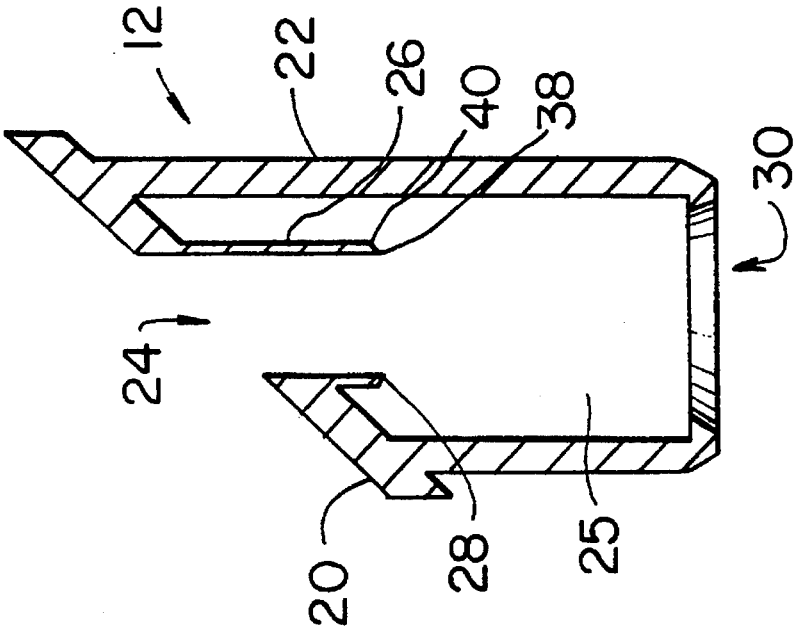
FIG. 2 is a vertical sectional view of the housing of FIG. 1.

As shown in FIGS. 1 and 2, a liquid applicator 10 in accordance with a preferred embodiment of the present invention comprises a housing 12, a valve member 14, a spring member 16, and a sponge-like spreader member 18 for uniformly distributing a liquid contained in a container (not shown) attachable to said applicator. The housing 12 has a top wall 20 and a side wall 22, the top wall 20 having an aperture 24 therein for dispensing the liquid such, for example, as liquid shoe-polish. The top wall 20 and side wall 22 define an internal chamber 25. As shown the top wall 20 may, for example, be selectively inclined so as to provide a less obstructive view of the shoe surface to the user. Of course, if desired, the top wall 20 may be level and may be of any shape such, for example, as rectangular or circular. The surface of the top wall 20 is preferably flat so as to facilitate attachment of the spreader member 18.

Still referring to FIGS. 1 and 2, there is illustrated an annular sleeve 26 which depends from the edge or an the inner surface of the top wall 20. The annular sleeve 26 projects inwardly into the internal chamber 25 in a surrounding relation with the aperture 24. The annular sleeve 26 forms a tubular channel or conduit from the internal chamber 25 to the outside of the housing 12. The annular sleeve 26 has an inner end portion 28 that is advantageously flexible and shaped to form a sealing surface. The end portion 28 may be made flexible by, for example, having a cross-section that is advantageously tapered so that its tip 38 is narrower than its base 40. It is readily understood that a cross-section having a shape such, for example, as a semicircle may also be employed and is contemplated within the scope of the present invention.

In the preferred embodiment, as depicted in FIGS. 1 and 2, a bottom end of the housing 12 has an inwardly directed integral collar 36 with an inlet 30 formed therethrough for fluid communication with a liquid source. Of course, the inlet 30 may also be defined on any portion of the housing 12. Also depicted in the figure is the top wall 20 being inclined relative to the annular sleeve 26 and/or the side wall 22.

Figure 3A:
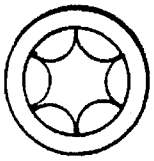
FIG. 3A is a top view of an embodiment of the valve member of FIG. 1 showing a 6-flute configuration.
Figure 3B:
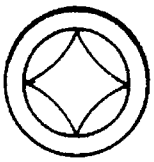
FIG. 3B is a view similar to FIG. 3A illustrating a 4-flute configuration.
Figure 3:
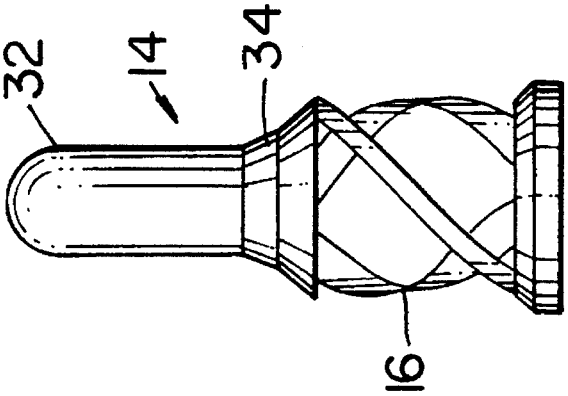
FIG. 3 is a side view of a spring mounted valve member of the liquid applicator of FIG. 1.

As shown best in FIG. 3, the valve member 14 has an actuating part 32 disposed at its distal end and a sealing part 34 disposed at its proximal end, which parts may be either integrally formed or separately made and later assembled. The actuating part 32 may be shaped as, for example, a shaft and dimensioned for slideable displacement within the annular sleeve 26. The length of the actuating part 32 is preferably such that when the sealing part 34 of the valve member 14 is urged into contact with the flexible end portion 28 of the annular sleeve 26 (see FIG. 1), a portion of the actuating part 32 protrudes from the top wall 20. The outer circumferential surface of the actuating part 32 is preferably fluted so as to lessen sliding friction when the actuating part 32 engages in slideable displacement within the annular sleeve 26. The fluted configuration is particularly useful when the top wall 20 is inclined relative to the annular sleeve 26 because the actuating part 32 is forced to slide against an inner surface of the annular sleeve 26 when a user presses the top wall 20 against a work surface. FIG. 3A illustrates a "6-flute" configuration while FIG. 3B depicts a "4-flute" configuration. Of course, other numbers of flutes may be employed. It will be readily appreciated that the fluted configuration, when compared to a non-fluted one, also enables a greater amount of liquid to flow through the annular space defined by the outer surface of the actuating part 32 and the inner surface of the annular sleeve 26 thereby allowing a user to more quickly apply the liquid onto the work surface.

The sealing part 34 of the valve member 14 is shaped to form a sealing surface with the corresponding flexible end portion 28 of the annular sleeve 26. Preferably, the sealing part 34 is configured as an annular collar such that the sealing surface is characterized by a generally sloping or inclined surface. The generally sloping surface permits the sealing part 34 to form an effective seal with the annular sleeve 26 even though the annular sleeve 26 may exhibit a smaller or larger than anticipated diameter due to variations inherent with a manufacturing process. This feature allows for less stringent manufacturing requirements and thus decreases manufacturing cost. The sealing part 34 is preferably made of a compliant material such, for example, as plastic or elastomer, which provides a yieldable sealing engagement with the end portion 28 of the annular sleeve 26.

The spring member 16 biases the valve member upwardly as viewed in FIG. 1 and by virtue of its resiliency yields to downward forces against actuating part 32 to thereby permit the seal 28–34 to be opened to permit the flow of liquid in the space between activating part 32 and annular sleeve 26. Spring member 16 is preferably made as an integral part of the valve member 14 though it may be fabricated as a separate, individual unit and later assembled with the remainder of the valve member. An advantage of having a separate spring member 16 is that the user may select a spring member with the desired stiffness thus allowing one to customize each applicator 10 for a particular usage. The spring member 16 may be held in the housing 12 by features such, for example, as a swaged end 36 as shown in FIG. 1.

In the preferred embodiment, the valve member and the spring member are unitarily or integrally constructed such, for example, by plastic injection molding.

In a typical application of the present invention, the liquid applicator 10 is attached to a bottle containing a liquid shoe polish (not shown), or other liquid. A user wishing to apply the liquid shoe polish inverts the bottle and presses the spreader member 18 of the applicator 10 against the shoe surface with such a force that the protruding portion of the actuating part 32 of the valve member 14 is forcibly pushed into the housing 12 against the bias of spring 16. The inwardly sliding action of the valve member 14 causes its sealing part 32 to disengage from the end portion 28 of the annular sleeve 26 thereby allowing the liquid shoe polish from the bottle to flow through the annular space now formed between the valve member 14 and the annular sleeve 26. The released liquid shoe polish wets the spreader member 18 thus enabling the user to spread the liquid uniformly over the intended surface. The user may terminate the flow of liquid polish from the bottle by simply lifting the applicator away from the shoe surface so that the spring member 16 again urges the sealing part 34 of the valve member 14 to seal against the end portion 28 of the annular sleeve 26 to discontinue the flow.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A liquid dispensing applicator for applying a liquid onto a work surface by operatively pressing an angularly-inclined liquid-dispensing end of the applicator against the work surface, said applicator comprising:

an elongated housing defining a longitudinal axis and an internal chamber for containing a liquid for dispensed application by said applicator onto a work surface, said housing including a top wall at a liquid-dispensing longitudinal end of said housing and inclined relative to said longitudinal axis for defining an angular inclination relative to said longitudinal axis at which said housing is operatively maintained relative to a work surface for operatively applying the contained liquid to the work surface by pressing the dispensing end of the applicator against the work surface, and an elongated sleeve defining a passage radially bounded by an interior periphery and extending into said internal chamber from said housing top wall to an interior end of said sleeve to define a sealing seat;

a valve member comprising an elongated shaft disposed for longitudinal sliding movement at least partly within and along said sleeve passage and a sealing member integral with said shaft and carried at an interior end of said shaft disposed within said housing chamber for longitudinal sliding movement of the sealing member with said shaft, said shaft having a predetermined cross-sectional configuration and size to define, between said sleeve periphery and said shaft, a flow space within and along which the contained liquid is flowingly communicatable from said housing chamber to said housing top wall and outwardly from said housing for application of the contained liquid to a work surface, and said valve member being movable along said longitudinal housing axis between a first position in which a dispensing end of said shaft opposite said interior end extends outwardly from said sleeve passage and beyond said inclined top wall and in which said sealing member engages said sleeve sealing seat to form a liquid-tight seal between said sealing member and sealing seat for preventing passage of contained liquid from said housing chamber into said flow space and outwardly from said housing for dispensed application to a work surface, and a second position in which said sealing member is spaced from said sleeve sealing seat to permit passage of contained liquid from said housing chamber into said flow space for dispensed application to a work surface, said sealing member comprising an inclined contact surface extending radially outwardly beyond said sleeve periphery for releasable liquid-tight sealing engagement with said sleeve sealing seat; and a helical spring disposed between said housing and said valve member for normally urging said valve member to said first position forming a liquid-tight seal with said sleeve sealing seat for preventing passage of contained liquid from said housing chamber into said flow space and outwardly from said housing, said helical spring being resiliently compressible as the applicator dispensing end is pressed against the work surface to apply to the dispensing end of said shaft a combination of longitudinal forces directed substantially along said longitudinal axis and transverse forces directed, by virtue of said inclination, substantially transverse to said longitudinal axis to move said valve member from said first position to said second position against the urgency of said helical spring and thereby space said sealing member from said sleeve sealing seat to permit passage of contained liquid from said housing chamber into said flow space and outwardly of said housing beyond said housing top wall for dispensed application onto a work surface;

said shaft being cross-sectionally fluted so that predetermined peripheral portions of said shaft are maintained in substantial contact with said sleeve periphery for guiding said shaft for longitudinal movement within and along said sleeve as said shaft operatively moves along said housing axis between said first and second positions in response to said application of combined longitudinal and transverse forces to said shaft dispensing end as said applicator is operatively employed for dispensingly applying contained liquid to a work surface, and so as to define, between said predetermined peripheral portions of said shaft, said flow space between said sleeve periphery and said shaft and along which the contained liquid is flowingly communicatable from said housing chamber to said housing top wall and outwardly from said housing for application of the contained liquid to a work surface.

2. A liquid dispensing applicator in accordance with claim 1, wherein said sealing member further comprises a substantially conical member.

3. A liquid dispensing applicator in accordance with claim 1, further comprising means carried on said inclined top wall for spreading contained liquid dispensed operatively outward from said flow space and housing for application to a work surface, said spreading means having a surface spaced from said top wall and extending substantially parallel to said angularly inclined top wall for contact with a work surface as the applicator is operatively pressed at said angular inclination against the work surface.

4. A liquid dispensing applicator in accordance with claim 3, wherein said spreading means comprises a sponge-like material.

* * * * *